US005899383A

United States Patent [19]

Hickey et al.

[11] Patent Number: 5,899,383

[45] Date of Patent: May 4, 1999

[54] CERAMIC FUEL INJECTOR TIMING PLUNGER

[75] Inventors: Dan K. Hickey; J. Victor Perr, both of Greenwood; David M. Rix, Columbus; Joseph C. Bentz, Columbus; Thomas M. Yonushonis, Columbus; Malcolm G. Naylor, Jonesville, all of Ind.; Katsuhiro Shinosawa, Tokyo, Japan; John T. Carroll, III, Columbus, Ind.

[73] Assignee: Cummins Engine Company, Inc., Columbus, Ind.

[21] Appl. No.: 08/803,511

[22] Filed: Feb. 20, 1997

Related U.S. Application Data

[63] Continuation of application No. 08/245,589, May 18, 1994, abandoned, and a continuation-in-part of application No. 08/556,391, Nov. 9, 1995, abandoned.

[51] Int. Cl.[6] ..... F02M 55/00

[52] U.S. Cl. ..... 239/88

[58] Field of Search ..... 239/88–90, 94, 239/533.1–533.12; 123/90.5, 90.51, 90.61

[56] References Cited

U.S. PATENT DOCUMENTS

| | | | |
|---|---|---|---|
| 4,235,374 | 11/1980 | Walter et al. . | |
| 4,266,729 | 5/1981 | Kulke et al. . | |
| 4,396,151 | 8/1983 | Kato et al. . | |
| 4,410,137 | 10/1983 | Perr . | |
| 4,463,901 | 8/1984 | Perr et al. . | |
| 4,531,672 | 7/1985 | Smith . | |
| 4,794,894 | 1/1989 | Gill . | |
| 4,806,040 | 2/1989 | Gill et al. . | |
| 4,848,286 | 7/1989 | Bentz | 123/90.61 |
| 4,951,631 | 8/1990 | Eckert . | |
| 4,951,874 | 8/1990 | Ohnishi et al. . | |
| 4,969,600 | 11/1990 | Nicol . | |
| 5,007,584 | 4/1991 | Rossignol . | |
| 5,042,718 | 8/1991 | Bergmann et al. . | |
| 5,056,488 | 10/1991 | Eckert . | |
| 5,067,464 | 11/1991 | Rix et al. . | |
| 5,072,709 | 12/1991 | Long et al. . | |
| 5,082,180 | 1/1992 | Kubo et al. . | |
| 5,094,215 | 3/1992 | Gustafson . | |
| 5,094,397 | 3/1992 | Peters et al. . | |
| 5,215,449 | 6/1993 | Lliga | 417/462 |
| 5,239,951 | 8/1993 | Rao et al. | 123/90.5 |
| 5,409,165 | 4/1995 | Carroll, III et al. | 239/88 |

FOREIGN PATENT DOCUMENTS

| | | |
|---|---|---|
| 0450891 | 10/1991 | European Pat. Off. . |
| A1-0-677 656 | 10/1995 | European Pat. Off. . |
| 57-2458 | 7/1982 | Japan . |
| 58-146879 | 10/1983 | Japan . |
| 59-194568 | 12/1984 | Japan . |
| 60-104765 | 6/1985 | Japan . |
| 61-031659 | 2/1986 | Japan . |
| 61-283759 | 12/1986 | Japan . |
| 6-137231 | 6/1994 | Japan . |

OTHER PUBLICATIONS

*Ceramics for Automobiles,* Hisao Sakano et al., Sankaido Co., Ltd., Apr. 15, 1987, pp. 56–57.

*Primary Examiner*—Kevin Weldon

*Attorney, Agent, or Firm*—Sixbey, Friedman, Leedom & Ferguson; Charles M. Leedom, Jr.

[57] ABSTRACT

A wear and scuff-resistant timing plunger for a timing assembly in a unit fuel injector for an internal combustion engine is provided. The timing plunger is formed of a high thermal expansion ceramic with a thermal expansion coefficient greater than $6\times10^{-6}/°$ C. and a hardness greater than 800 $Kg/mm^2$, which maintains a desired diametral clearance and efficient plunger function without scuffing or sticking under the axial, tangential and pressure loads encountered in the fuel injector operating environment. Preferred high thermal expansion ceramics are zirconia, alumina-zirconia and alumina.

9 Claims, 2 Drawing Sheets

9.02
9.015
9.01
9.005
9
8.995
8.99
DIAMETER(mm)
-40
-20
0
20
40
60
80
100
120
140
TEMP.(°C)
A
B
C
D

CERAMIC FUEL INJECTOR TIMING PLUNGER

This is a Continuation application of Ser. No. 08/245,589, filed May 18, 1994 and a Continuation-in-Part of the intervening application Ser. No. 08/556,391 now abandoned, filed Nov. 9, 1995.

TECHNICAL FIELD

The present invention is directed generally toward timing plungers for fuel injectors and particularly to a scuff-resistant high performance fuel injector timing plunger made of a ceramic material.

BACKGROUND OF THE INVENTION

Fuel injector timing plungers are required to operate under extremely adverse environmental conditions in a fuel injector assembly. Heavy mechanical loads are applied to the timing plunger in both axial and tangential directions. The plunger must reciprocate within a bore in the injector body that is often distorted so the original diametral clearance is not maintained, and the timing plunger is forced against the bore wall during injector operation, resulting in scuffing. Additionally, low quality and contaminated fuels contribute to the creation of an adverse timing plunger operating environment.

The timing plunger material has been modified throughout the years in an effort to make a timing plunger that is both scuff-resistant and wear-resistant and capable of functioning as required under the adverse conditions of the fuel injector environment. However, third body debris interferes with efficient injector function. Third body debris includes particles harder than the plunger or injector body bore which are not intended to be present within the injector. These particles become embedded into the timing plunger surface and ultimately cause the plunger and body to be wedged together so that the plunger cannot reciprocate in the injector body bore and becomes friction welded. The reduction of fuel lubricity, which could be caused by water contamination of the fuel, and may be a characteristic of some alternative fuels, is also a factor contributing to the friction welding of the timing plunger and injector body together. Injector operation is, of course, prevented if this occurs.

The prior art has proposed the use of wear-resistant materials and corrosion-resistant materials to form various structures and components of internal combustion engines. For example, U.S. Pat. Nos. 4,794,894 to Gill and 4,848,286 to Bentz are directed to ceramic tipped pivot rods, and U.S. Pat. No. 4,806,040 to Gill et al. is directed to a ceramic ball and socket joint. U.S. Pat. No. 4,266,729 to Kulke et al. discloses forming an injector valve needle tip and/or disc from a corrosion-resistant material, such as high quality steel, ceramic, or industrial glass. However, neither this are nor any of the prior art of which the inventors are aware addresses the specific problems of fuel injector timing plunger scuffing and sticking which are encountered with available fuel injectors, particularly those used in diesel engines.

The types of fuels increasingly used in diesel engines, particularly fuels with low lubricity, alternative fuels and fuels which may be contaminated with water, require a scuff-resistant fuel injector timing plunger to maintain efficient engine operation. The prior art has failed to provide a fuel injector timing assembly including a timing plunger that is sufficiently scuff-resistant and wear-resistant, particularly when exposed to third body debris and such adverse operating conditions as low lubricity and contaminated fuels to operate efficiently. A need exists for such a fuel injector timing plunger.

SUMMARY OF THE INVENTION

It is a primary object of the present invention, therefore, to overcome the disadvantages of the prior art and to provide a fuel injector timing assembly including a scuff-resistant timing plunger for a unit fuel injector for an internal combustion engine powered by diesel fuel.

It is another object of the present invention to provide a fuel injector timing assembly including a timing plunger for a diesel engine capable of operating efficiently in the presence of high axial and tangential loads on the timing plunger.

It is a further object of the present invention to provide a diesel engine fuel injector timing plunger that is wear- and scuff-resistant and maintains an optimum diametral clearance so that it does not stick during fuel injector operation.

It is yet another object of the present invention to provide a reliable fuel injector timing assembly for an internal combustion engine that includes a wear- and scuff-resistant timing plunger reciprocally positioned within an injector body.

The foregoing objects are achieved by providing a fuel injector timing assembly including a timing plunger for a unit fuel injector for a diesel engine operably positioned within an injector body that is wear- and scuff-resistant and maintains a sufficient diametral clearance with the injector body so that the timing plunger reciprocates freely within the unit fuel injector body without sticking even under adverse engine operating conditions. The injector timing plunger is formed from a ceramic material having a thermal expansion coefficient sufficiently correlated to the thermal expansion coefficient of the fuel injector body to provide optimum operating clearance between the plunger and injector body during engine operation while preventing fuel leakage around the timing plunger.

Other objects and advantages will be apparent from the following description, claims and drawings.

DESCRIPTION OF THE PREFERRED EMBODIMENTS

Fuel injector timing plunger scuffing and sticking is one cause of high injector RPH (repairs per hundred). High warranty costs may result from the replacement of failed and inoperable timing plungers. The fuel injector body/timing plunger assembly of the present invention provides a reliable wear-resistant timing plunger that is free from sticking and scuffing, even when exposed to extremely abusive engine operating conditions. Consequently, the present invention effectively lowers both the injector RPH and warranty costs occasioned by failed and inoperable timing plungers.

Figure 1:
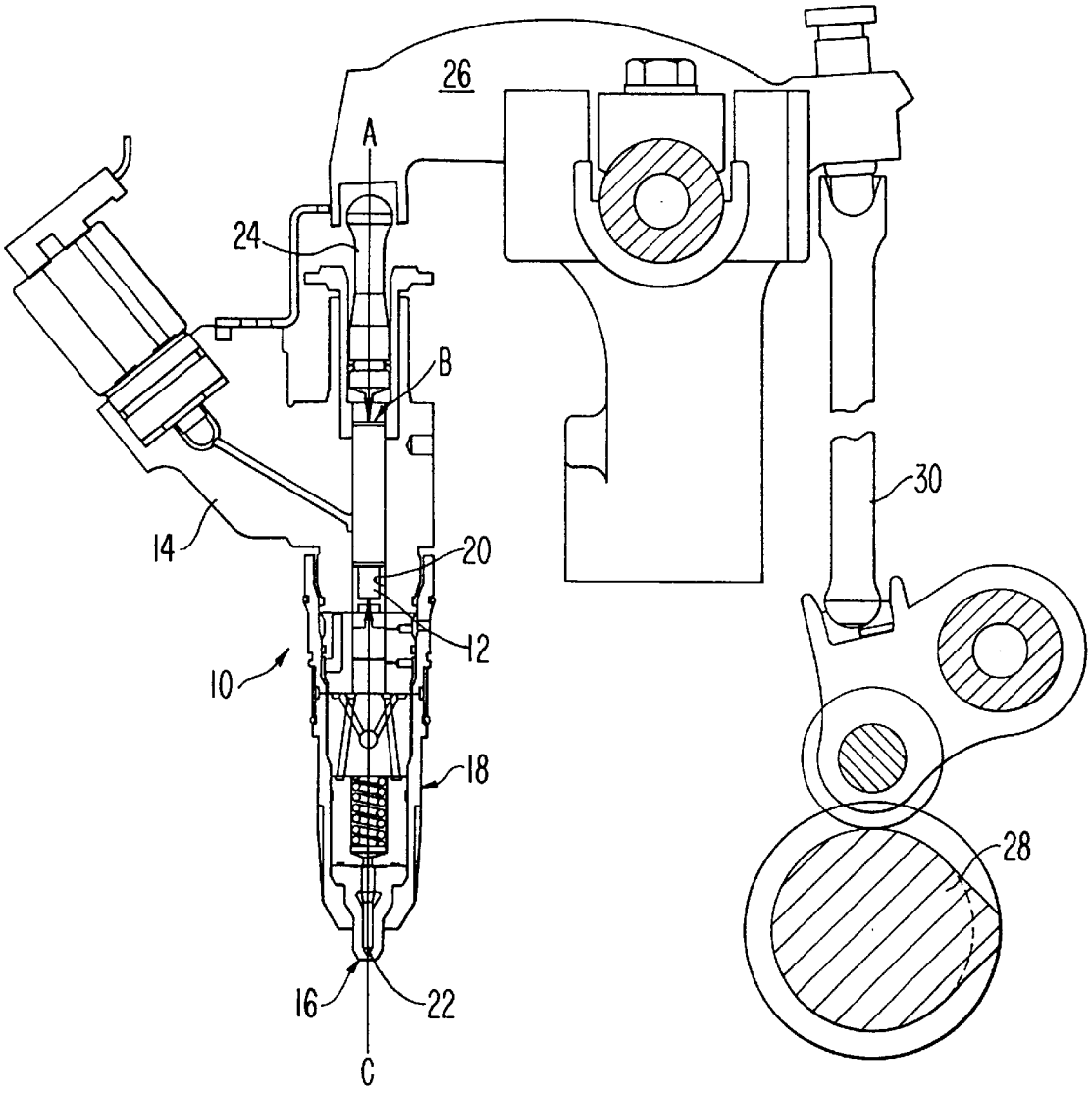
FIG. 1 is a schematic cross-sectional view of a fuel injector assembly in a diesel engine incorporating the scuff-resistant anti-stick timing plunger of the present invention.

Referring to the drawings, FIG. 1 illustrates, in cross section, an open nozzle unit fuel injector 10 with a timing assembly of the type that includes a timing plunger 12. This type of fuel injector includes a body 14 and an injector nozzle 16. The injector nozzle 16 and the body 14 are axially aligned and held together by a retainer 18. An axial bore 20 extends throughout the length of the body 14. A plurality of spaced injection orifices 22 in the nozzle 16 is provided at the injector cup terminus to optimize fuel injection.

The injector 10 includes a timing plunger 12 that reciprocates axially within the injector along with a link 24 that is engaged by one end of a rocker lever 26. The other end of the rocker lever 26 is drivingly connected to the camshaft 28 via a pushtube 30. The rocker lever 26 typically applies both axial and tangential loads to the timing plunger 12 during engine operation. Arrow (A) represents the axial load applied to the timing plunger 12 by the rocker lever 26. Arrow (B) represents the tangential or side load applied to the timing plunger 12 by the rocker lever 26. The axial load applied by the rocker level 26 to the timing plunger 12 as it reciprocates in the injector body 14 can be elevated to as high as 2400 pounds. In addition to these axial and tangential loads, pressures as high as 24,500 psi are generated by the timing plunger's downward stroke as it travels toward the injector nozzle 16. This results in a load of 24,500 psi acting on the timing plunger 12 in an upward axial direction, away from the nozzle 16 and toward the rocker lever 26, as shown by arrow (C).

The ceramic timing plunger 12 is sized relative to the injector body bore 20 to provide a diametral clearance of 76–128 millionths (0.000076–0.000128) of an inch. The diametral clearance can be less than that of known plunger designs due to differences in thermal expansion between the currently available stainless steel plunger and the ceramic timing plunger 12. The aforementioned loads on the timing plunger and the clamp load on the injector body 14 often distort the axial bore, which decreases the diametral clearance. The rocker lever generated side load (arrow B) then forces the timing plunger 12 against the wall of the body bore 20. Plunger scuffing and wear occur under such circumstances. The presence of third body debris in the injector body bore compounds the plunger problems under these loads.

The severity of the timing plunger operating environment is further increased by low sulfur and low lubricity fuels and fuels contaminated by water. Until the present invention, a fuel injector timing plunger that is scuff and wear-resistant and capable of functioning without sticking or failure under the adverse conditions encountered in a fuel injector operating environment has not been available.

The present invention provides a fuel injector timing plunger assembly for an internal combustion engine unit fuel injector that includes a timing plunger with a substantially higher resistance to scuffing and sticking than the timing plungers currently in use. It has been discovered that forming the injector timing plunger of a hard, wear-resistant ceramic material avoids the scuffing and sticking problems that have plagued steel and other metal plungers and, additionally, resists the axially and tangential loads applied during engine operation more successfully than available timing plungers. A ceramic timing plunger presents many advantages. The kinds of ceramic materials evaluated for use as timing plungers are much harder than the materials currently used for either the timing plunger or the injector body. Moreover, the ceramic material has a low reactivity and a low affinity to weld with petroleum lubricated metal counterfaces. However, the optimum surface finish must be created for the best sliding wear performance.

Timing plungers made from high thermal expansion ceramics, including zirconia, alumina-zirconia and alumina have been demonstrated to show significantly better scuffing resistance than plungers made from metal. Although other ceramics, most notably silicon nitride, also display superior scuff resistance, only high thermal expansion ceramics have been found to be suitable for use in forming unit fuel injector timing plungers. Achieving the optimum fuel leakage around the plunger during engine operation is critical. Since ceramics with low thermal expansion allow excessive leakage, only high thermal expansion ceramics are capable of maintaining fuel leakage within acceptable parameters. The preferred ceramic materials for use in forming fuel injector timing plungers are those with a thermal expansion coefficient greater than $6\times10^{-6}/°$ C. and a hardness greater than 800 $Kg/mm^2$. The thermal expansion coefficient of the ceramic selected for the timing plunger should match as closely as possible that of the metal forming the injector body.

Figure 2:
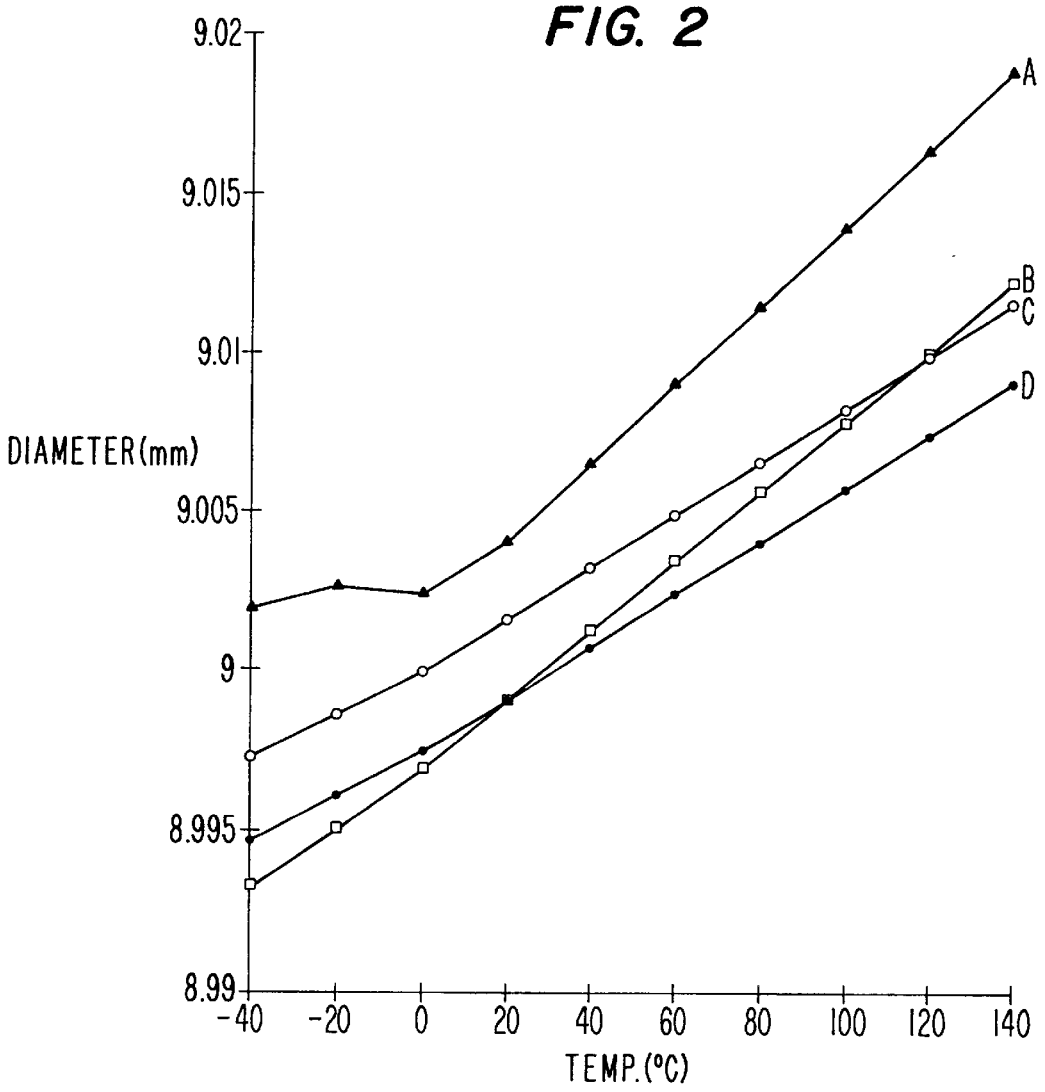
FIG. 2 presents graphically the dimensions of the injector body bore and timing plunger of the present invention for different materials at different temperatures.

FIG. 2 compares the diameters of the injector body bore 30 (FIG. 1) with the diameters of a timing plunger currently in use and two ceramic plungers with differing diametral clearances. Curve A represents the diameter of the injector body bore over the range of temperatures studied. Curve B shows the changes in plunger diameter when the timing plunger 12 is formed from stainless steel, which is the material presently used. The diametral clearance between the stainless steel timing plunger and the injector bore in the assembly tested was 5.0 microns. Curves C and D demonstrate diametral changes in timing plunger diameter for two ceramic timing plungers at different clearances. The diametral clearance between the timing plunger and the bore for the assembly represented by curve C. was 2.5 microns, while the clearance between the curve D timing plunger assembly was 5.0 microns. FIG. 2 clearly demonstrates that a ceramic timing plunger in accordance with the present invention can have a smaller diametral clearance in the injector bore than the presently used stainless steel plunger and still function effectively in the presence of the loads applied to the timing plunger during engine operation.

Unit fuel injector timing plungers with thermal expansion coefficients and hardness characteristics in the aforementioned range have survived extremely abusive bench and engine tests which have destroyed standard steel timing plungers. Injector RPH and warranty costs have been reduced by the use of ceramic timing plungers in timing assemblies for unit fuel injectors.

Industrial Applicability

The timing plunger of the present invention will find its primary application as an integral component of an injector timing plunger assembly for a unit fuel injector in an internal combustion engine, particularly a heavy duty diesel-type engine.

We claim:

1. A fuel pressurizing assembly operable over a temperature range from −40 to 140 degrees centigrade for increasing cyclically the pressure of a fuel, that may contain abrading particulates and lubricity lowering contaminates, to an injection pressure sufficiently high to permit combustion of the fuel when the fuel is injected into the combustion chamber of a compression ignition engine, comprising a body containing an axial bore defined by a inner surface having a predetermined bore diameter into which fuel may be supplied on an intermittent basis for pressurization, said body being formed of a metal having a predetermined thermal expansion coefficient, a plunger mounted for reciprocating movement within said axial bore to form a variable volume fuel pressurization chamber, pressurization means for applying a periodic pressurization force to said plunger to cause cyclical fuel pressurization within said pressurization chamber, said pressurization force including a substantial side loading force which tends to bias the external surface of said plunger into contact with the surrounding inner surface of said bore, wherein said plunger has a predetermined plunger diameter slightly less than said predetermined bore diameter to form a diametral clearance between said bore and said plunger that is greater than 76 millionths of an inch and less than 128 millionths of an inch to permit adequate lubrication between the external surface of said plunger and the surrounding inner surface of said bore and yet preclude excessive fuel leakage out of said pressurization chamber, said plunger being formed of a scuff resistant, wear resistant ceramic material having a low reactivity and low affinity to weld with the fuel lubricated inner surface of said axial bore and a temperature dependent thermal expansion coefficient which is sufficiently similar to the thermal expansion coefficient of said metal forming said body over a temperature range of −40 to 140 degrees centigrade to maintain the diametral clearance within a range that insures adequate lubrication without excessive fuel leakage as said plunger reciprocates within said axial bore to cyclically pressurize fuel within said pressurization chamber under long term adverse engine operating conditions, said ceramic material having a thermal expansion coefficient greater than $6\times10^{-6}/°$ C. and a hardness greater than 800 $Kg/mm^2$.

2. A fuel pressurizing assembly as defined by claim 1, including a unit injector adapted to be mounted adjacent a combustion chamber of an internal combustion engine having a cam shaft and a cam actuated system adapted to contact the cam shaft at one end and said plunger at its other end to cause said plunger to reciprocate as the cam shaft rotates, said unit injector including an injector nozzle containing at least one injection orifice through which fuel may be injected at high pressure into the combustion chamber of the engine and a retainer for holding said nozzle in alignment with said body.

3. A fuel pressurizing assembly as defined in claim 2, wherein said cam actuated system includes a rocker lever, a push tube operatively extending from the camshaft to one side of said rocker lever and a link operatively extending from the other side of said rocker lever to said plunger to cause said plunger to reciprocate as the cam rotates whereby a high axial force is imposed on said plunger by said link as said plunger is advanced toward said injector nozzle and a side force is simultaneously imposed on said plunger by said link to bias said plunger toward the inner wall of said bore.

4. A fuel pressurizing assembly as defined in claim 1, wherein said plunger is a timing plunger.

5. A fuel pressurizing assembly as defined in claim 3, wherein said plunger is a timing plunger.

6. A fuel pressurizing assembly as defined in claim 1, wherein said plunger is formed of a homogeneous, chemically inert ceramic material selected from the group consisting of zirconia, alumina-zirconia and alumina ceramics.

7. A fuel pressurizing assembly as defined in claim 3, wherein said plunger is formed of a homogeneous, chemically inert ceramic material selected from the group consisting of zirconia, alumina-zirconia and alumina ceramics.

8. A fuel pressurizing assembly as defined in claim 4, wherein said timing plunger is operably positioned entirely within said bore of said body and operates to control fuel injection at selected intervals.

9. A fuel pressurizing assembly as defined in claim 5, wherein said timing plunger is operably positioned entirely within said bore of said body and operates to control fuel injection at selected intervals.

* * * * *

UNITED STATES PATENT AND TRADEMARK OFFICE

CERTIFICATE OF CORRECTION

PATENT NO. : 5,899,383 
DATED : May 4, 1999
INVENTOR(S) : Dan K. Hickey, J. Victor Perr, David M. Rix, Joseph C. Bentz, Thomas M. Yonushonis, Malcolm G. Naylor, Katsuhiro Shinosawa, and John T. Carroll, III It is certified that error appears in the above-identified patent and that said Letters Patent is hereby corrected as shown below:

Title page,
Under item [73] Assignee, add -- Toshiba Corporation, Tokyo, Japan --.

Signed and Sealed this

Ninth Day of October, 2001

*Attest:*

Nicholas P. Godici

*Attesting Officer*

NICHOLAS P. GODICI
*Acting Director of the United States Patent and Trademark Office*